United States Patent [19]

Altrogge

[11] Patent Number: 4,611,430

[45] Date of Patent: Sep. 16, 1986

[54] DOOR MOUNTED OPERATING MECHANISM FOR AN OVERHEAD DOOR

[76] Inventor: Wilhelm E. Altrogge, Lange Strasse, Postfach 1101, D 4937 Lage (Lippe), Fed. Rep. of Germany

[21] Appl. No.: 675,816

[22] Filed: Nov. 28, 1984

Related U.S. Application Data

[63] Continuation-in-part of Ser. No. 271,976, Jun. 9, 1981, abandoned.

[30] Foreign Application Priority Data

Oct. 6, 1980 [DE] Fed. Rep. of Germany ..... 3021724

[51] Int. Cl.[4] ..... E05F 15/20

[52] U.S. Cl. ..... 49/199; 49/358

[58] Field of Search ..... 49/199, 200, 358, 359

[56] References Cited

U.S. PATENT DOCUMENTS

| | | | |
|---|---|---|---|
| 1,465,695 | 8/1923 | Stewart | 49/200 |
| 2,751,219 | 6/1956 | Dodge | 49/199 X |
| 2,770,455 | 11/1956 | Brister | 49/200 |
| 3,591,981 | 7/1971 | Law | 49/199 X |
| 3,708,917 | 1/1973 | Streeter | 49/199 X |
| 4,131,830 | 12/1978 | Lee et al. | 49/199 X |
| 4,147,073 | 4/1979 | Mercier | 49/199 X |
| 4,167,833 | 9/1979 | Farina et al. | 49/199 |

FOREIGN PATENT DOCUMENTS

| | | | |
|---|---|---|---|
| 2649150 | 5/1978 | Fed. Rep. of Germany | 49/199 |

*Primary Examiner*—Philip C. Kannan

*Attorney, Agent, or Firm*—Andrus, Sceales, Starke & Sawall

[57] ABSTRACT

An operating mechanism for an overhead door has a drive pulley mounted on the door. A drive motor is coupled to the pulley. An arm pivotally mounted on the door extends from the upper portion of the door generally in the direction of opening movement of the door. A guide cable is mounted on the end of the arm. A drive cable strung above the door extends in a path from the front of the building, around the guide pulley, around the drive pulley, and over the guide pulley to the rear of the building. The guide pulley prevents contact between the top of the door and the cable. The drive motor may be movably mounted in the operating mechanism for performing a variety of control functions.

19 Claims, 3 Drawing Figures

DOOR MOUNTED OPERATING MECHANISM FOR AN OVERHEAD DOOR

The present application is a continuation-in-part of U.S. patent application Ser. No. 06/271,976 filed June 9, 1981 and now abandoned.

The present invention is directed to an operating mechanism for an overhead door in which the driving portions are mounted on the moving door rather than on a stationary structure, such as a garage.

In the conventional technology of door operators, the driving portions are mounted on the garage. However, these operators require ample head room and skilled artisans for installations. Such operators are also expensive.

There are numerous advantages in having the driving portion of the mechanism installed on the door. One of these is quick installation. In the past, however, certain problems have prevented widespread use of operating mechanisms of this type. One such problem has been the turning over or bending of the traction element at the edge of the head of the door panel. One solution has been to drive the door by pulleys running on the horizontal rails of the overhead door. While this overcomes the foregoing problem, it is applicable only to new equipment of this type. In another approach, the wire rope of the drive has been installed under the door frame at the top of the door. The end of the wire rope was attached outside of the garage. This was not entirely satisfactory.

Another recent development has been to different mechanisms that, shortly after opening of the door, automatically go forward over the head of the door panel. However, only a construction having a turnover mechanism consisting in part of a chain connected with the wire rope provides a large enough turning diameter to prevent internal friction. The attendant disadvantages are low protection against dust, large space requirements, and high manufacturing costs. Further, these mechanisms that turn over the rope at the head of the door need, not only space over the door, but also space in the interior of the housing the operator. There is also increased friction in the extra moving parts that are required.

With the drive portion of the operator mounted in the door, the possibility of energizing the operator with batteries presents itself. However, experiments to date have used heavy automotive batteries. Mechanical and electrical losses must be considerably reduced in order for such batteries to work.

The object of the present invention is to provide an improved operating mechanism for overhead doors with a gear motor drive portion fastened to the door panel. The gear motor drives a pulley with a looped traction element of chain, rope, cable, or the like. The mechanism follows a line of self-transport parallel to the ceiling. The mechanism is so designed that when the door is in a moving position, contact between the top of the door and the traction element is eliminated by a pulley system.

The door operator of the present invention is suitable for a wide range of customers or car owners at reasonable prices. It is suitable for use in garages that are not connected to electrical mains. The operating mechanism can be installed on almost any available portion of the door panel. The operator has a reduced number of working parts. The mechanical efficiency of the operator is such as to permit the use of handy rechargeable batteries or small automotive battery chargers.

The invention will be further understood by reference to the following detailed specification and drawings.

Figure 1:
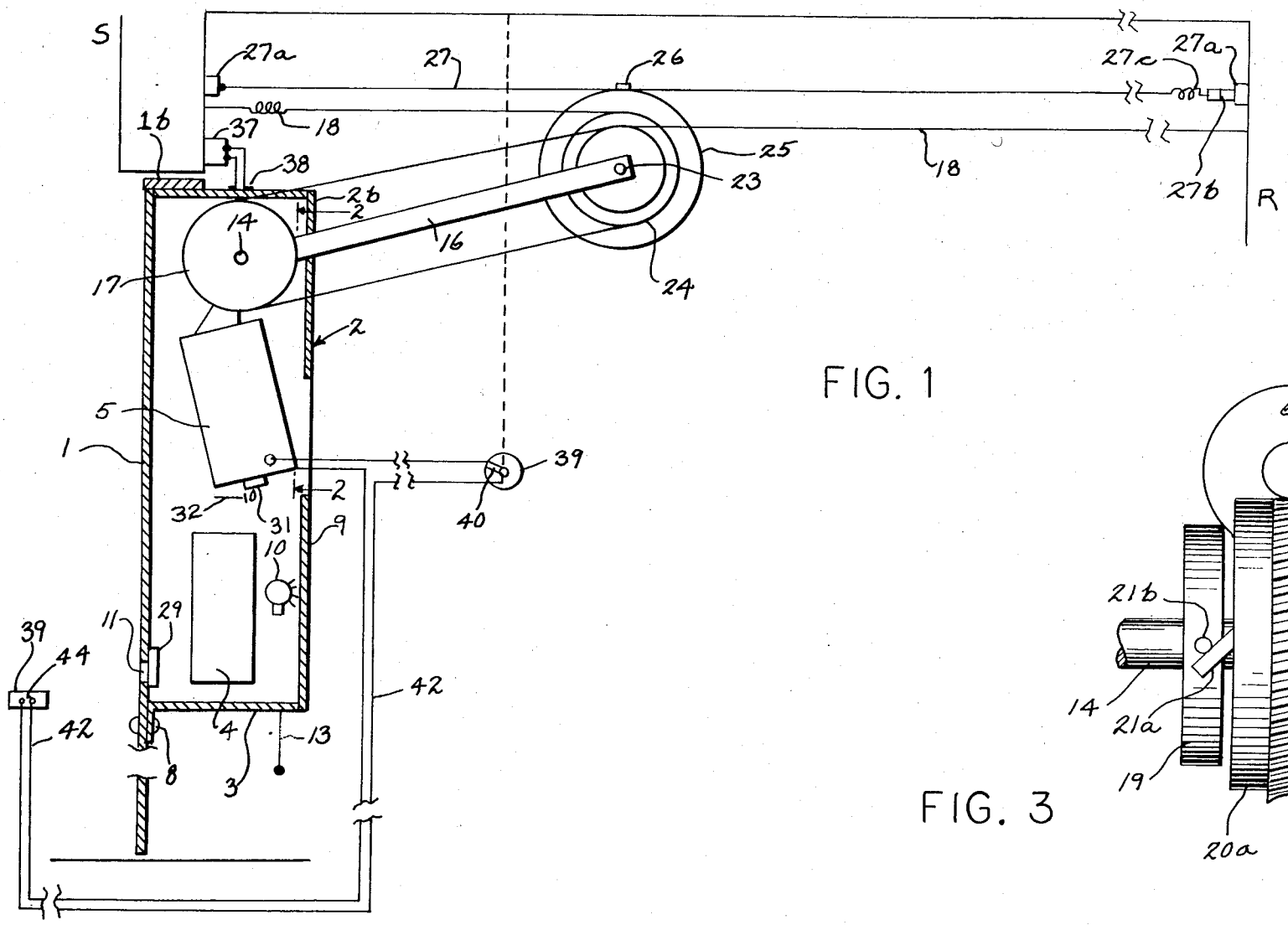
FIG. 1 is a cross-sectional view of the door opening mechanism of the present invention.

A garage with front wall S and rear wall R has overhead door 1 closing and opening across an entry in front wall S. Door 1 is shown in its vertical position in the cross-sectional side view of FIG. 1. The edge of the head of door 1 is indicated by the numeral 1*b*.

A guide cable or rope 27 extends between anchors 27*a* on the front and rear walls. Spring 27*c* may be provided at one end of cable 27. The cable may be electrified with a low voltage power supply 27*b* to supply power to the operator on door 1, if desired. Anchors 27*a* may include insulators in this instance.

A second, traction cable 18 extends between front wall S and rear wall R parallel to cable 27 to serve as a traction element for the operating mechanism. Cable 18 is tensioned by spring 18*a*.

The door operating mechanism of the present invention includes housing 2 mounted on the inner side of door 1. Housing 2 is typically 50 cm×12 cm×12 cm. Housing 2 may be formed of folded sheet metal having a protective covering plate 2*b*. Housing 2 has flanges by which the housing may be fastened to frame 7 of door 1 by fasteners 6. The bottom of housing 2 is fastened to door 1 by fasteners 8. Covering plate 9 of housing 2 is transparent so that lamp 10 contained in housing 2 can illuminate the interior of the garage. Window 11 is provided in housing 2 and door 1 for a purpose hereinafter described.

Drive axle 14 extends through the side walls of housing 2 and bearings 15. A pivoting arm 16 is mounted on axle 14 outside housing 2 by its forked end arms 16*a* and 16*b* that lie along either side of the housing. Drive pulley 17 is mounted on one end of axle 14 and has a groove for receiving cable 18.

Forked arm 16 is approximately 50 cm in length and lies at a small incline when door 1 is in the position shown in FIG. 1. A guide pulley 24 is mounted on axle 23 at the end of arm 16. A support-like pulley 25 is also mounted on axle 23 that, together with ring 26, holds arm 16 along guide cable 27 so that the arm is guided by cable 27. Traction cable 18 extends from front wall S around guide pulley 24, and around drive pulley 17 to rear wall R of the garage.

Figure 2:
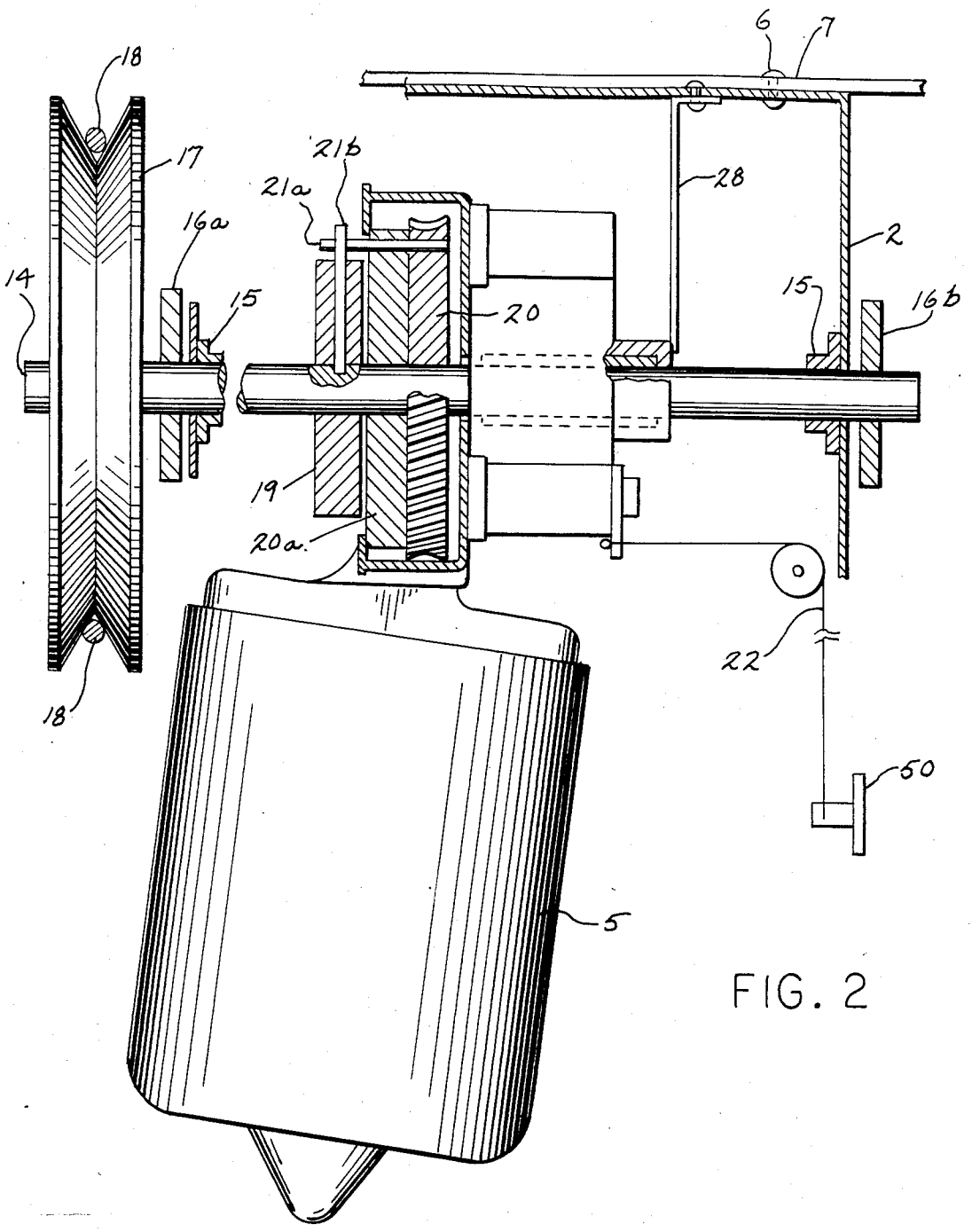
FIG. 2 is a detailed cross-sectional view taken along the line 2—2 of FIG. 1 showing a portion of the operating mechanism.

Disc 19 is fastened to drive axle 14 inside housing 2. Disc 19 has pin 21*b* extending therefrom. Gear motor 5 is suspended from drive axle 14. For economic, as well as other reasons, motor 5 may comprise a windshield wiper motor, the output shaft of which drives disc 20 contained in the motor housing through a worm gear drive 60. Disc 20 is reinforced by disc 20*a*. Discs 20 and 20*a* are journalled on drive axle 14 and can slide, together with motor 5 along drive axle 14. Disc 20*a* has pin 21*a* extending therefrom that engages pin 21*b* in disc 19 when discs 19 and 20*a* are contiguous, as shown in FIG. 2 so that motor 5 can rotate drive axle 14. Spring 28 may be provided in housing 2 to bias discs 19 and 20*a* together. Cable 22 is fastened to motor 5—discs 20 and 20*a* to draw disc 20*a* to the right, when oriented as in FIG. 2 in the event it is necessary to disengage the driving mechanism. Cable 22 may be controlled by the locking handle 50 for door 1 positioned on the outside of the door and having a drum or bell crank for actuating cable 22.

Figure 3:
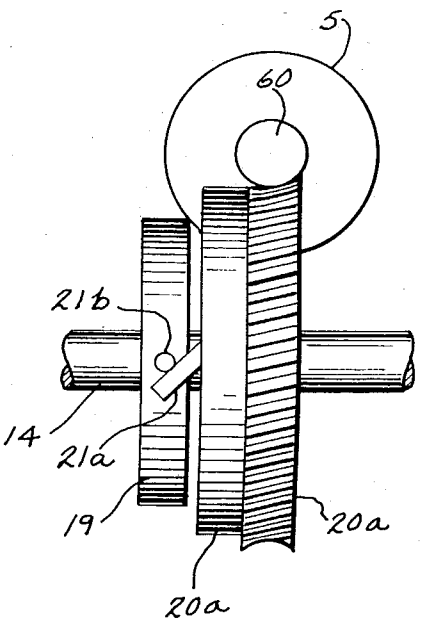
FIG. 3 is a fragmentary view showing a drive means for use in the door opening mechanism of the present invention.

Means may be provided to automatically disengage pins 21*a* and 21*b* in the event a predetermined load is encountered. As shown in FIG. 3, this may be accomplished by slanting pin 21*a*. An overload condition will move disc 20*a* to the right, when oriented as in FIG. 2, against spring 28 to disengage motor 5 from shaft 14.

Switch 31 is provided on motor 5 that is actuated by abutment 32 in housing 2 responsive to rotary movement of motor 5 about drive axle 14.

Batteries 4 for energizing motor 5 are provided on the bottom 3 of housing 2 below motor 5. Batteries 4 may be of the lead-gel type having small capacity reduction. Two batteries may be used, each having a capacity of 10 ampere hours at 6 volts. Such batteries are typically 15 cm×10 cm×5 cm in size. Placing batteries 4 under motor 5 makes them easily accessible at eye level and thus easy to change.

To install the drive operator of the present invention, housing 2 with arm 16 and pulley 24 are fastened on door 1. Prior to installation, housing 2 is easily transported by arm 16. After installation of housing 2 on door 1, cable 18 is wound around drive pulley 17 and guide pulley 24 and fastened to front wall S and rear wall R of the garage. In this manner the installation of cable 18 is quite independent from the installation of the mechanism of housing 2 on door 1. The attachment of cable 18 can be easily done by the do-it-yourselfer in contrast to the difficult installation of conventional operators under the ceiling of the garage. Because the door operator of the present invention allows plenty of space above the door head, spring 18*a* can be easily integrated in traction cable 18. Cable 27 is attached to front wall S and rear wall R to extend through ring 26 to support the outer end of arm 16.

To open door 1, driving axle 14 and drive pulley 17 will turn in the counterclockwise direction, when viewed as in FIG. 1. Gear motor 5 drives pulley 17 to move the drive mechanism along cable 18 to the rear wall of the garage, carrying overhead door with it.

When door 1 is fully open, drive pulley 17 stops rotating in the counterclockwise direction. This causes a clockwise rotation of gear motor 5 that causes switch 31 to strike stop 32 to turn off the motor. The same occurs if gear motor 5 encounters a predetermined overload when door 1 is being opened.

In the movement of door 1, guide pulley 24 protects the traction elements from contact against the door edge. The bending of cable 18 between front wall S, guide pulley 24 and drive pulley 17 forms a small angle so that arm 16 produces only a slight reduction in the traction power of gear motor 5.

To close door 1, gear motor 5 is energized to rotate drive pulley 17 in the clockwise direction so that the door and operating mechanism return to the position shown in FIG. 1. In the closing movement of door 1, arm 16 is supported by support-like pulley 25. In the event door 1 overrides motor 5 during closing movement, switch 31 will be actuated to stop motor 5.

Because of spring 18*a* in cable 18, the friction condition of the cable loop around drive pulley 17 automatically adjusts to a condition in which drive pulley 17 is gliding, i.e. not driven. This permits door 1 to be opened manually. A similar gliding condition occurs if the door is overweighted or strikes an object, such as a car, when closing.

The simplicity of the mechanical construction of the operator of the present invention results in high efficiency and power transmission. Door 1 is preferably provided with good rolling/gliding characteristics during its movement between the open and closed positions. These factors permit small batteries 4 to be used for about a month of average door operation without recharging.

The operator of the present invention has the ability to be utilized also in large doors requiring heavy traction, notwithstanding its light weight. The operator is preferably installed on the side of the door and employs a block-and-tackle system in conjunction with idlers to return the traction force to the door.

The use of batteries 4 permits the door operating mechanism of the present invention to be used in garages without electrical power, as where the installation of underground power cable would be too expensive. Even where power is available, the battery operated mechanism of the present invention can be used to advantage since the need for transformers used with large doors can be eliminated as can the cable between the door and the transformer. Voltage losses are eliminated in this manner. In the intervals between door movements, the batteries can be recharged with a charging unit.

The circuitry may be designed such that when the voltage of batteries 4 is reduced, the door operator will still open the door so that the vehicle can be removed. However, a relay system in the circuitry is designed so that the door cannot be closed with the door operator with batteries 4 at reduced voltage. This is a signal to the garage owner to change or charge batteries 4. The batteries may be recharged through the use of a voltage source in the automobile, such as a small, transistorized, low tension charger. Or, as noted above, batteries 4 may be recharged from available power mains.

The owner of a garage with 220 volt current can employ a small battery charger 37 mounted on the wall above the top of the door. Only in the closed position of the door are contacts 38 connected to the charger to charge the batteries. When the door is in motion, the door operator can be energized independently by means of batteries 4. The batteries permit use of the operator for an extended period in the event of a failure of 220 volt current.

Alternately, batteries 4 could be charged with solar cells 29. These can be installed on the door panel in window 11, shown in FIG. 1. It is possible to combine the photodiode of a receiver of an optical remote control in the door with the solar cells.

Or, a radio receiver supplied by a miniature battery charged with the solar cells may be placed in door 1. Antenna 13 may be attached to the bottom plate 3 of housing 2, as shown in FIG. 1.

In a simple embodiment of the invention, gear motor 5 may be energized by the battery in the garage owner's vehicle. This permits certain components in the housing 2 to be eliminated, such as the optical or radio control and batteries 4. The driver of the vehicle stops beside a pillar 39 in front of his garage. The car window is opened to arrange a contact between stationary cable 42 and a 12 V contact in the vehicle. At the end of cable 42 is a plug 44 for receiving a connection to the car. The polarity of the applied voltage can be used to select the closing or opening operation of the door.

Mercury switch 39–40 suspended from the roof of the garage can open to interrupt the power supply to disengage motor 5 automatically if the switch comes in touch with the roof of an automobile in the garage so that an unauthorized person is not able to operate motor 5 from outside the garage. With a door opener such as is shown in FIG. 1, mercury switch 39–40 could be used to disengage the receiver of the remote control control when a vehicle is in the garage. A reduced security code system in the remote control is then sufficient to avoid risk of theft, since when the car is in the garage, remote control of the door operator is impossible.

Various modes of carrying out the invention are contemplated as being within the scope of the following claims particularly pointing out and distinctly claiming the subject matter which is regarded as the invention.

I claim:

1. An operating mechanism for moving a door relative to a building structure along a path of opening movement having a vertical portion and a horizontal portion extending from the front to the rear of the building, said operating mechanism being mountable adjacent the upper edge of the door and comprising:

a drive pulley (17) mounted on the door (1) for rotation about an axis (14) normal to the direction of movement of the door;

a drive motor (5) selectively coupled to said drive pulley for rotating same;

an arm (16) pivotally mounted on the door and extending therefrom generally in the direction of the opening movement of the door;

a guide pulley (24) mounted on said arm for rotation about an axis parallel to the axis of said drive pulley; and a cable (18) mounted on the building structure along the path of movement of the door, said cable being strung in a course extending rearwardly from the front of the building structure, around said guide pulley (24), around said drive pulley (17), and returning over said guide pulley (24) to the rear of the building structure.

2. The operating mechanism as claimed in claim 1 wherein said cable (18) includes spring means **(18*a*) permitting said drive pulley (17) to glide with respect to said cable (18)**.

3. The operating mechanism as claimed in claim 1 wherein said motor and drive pulley include a worm gear coupling said drive motor to said pulley.

4. The operating mechanism as claimed in claim 1 including means (39, 42, 44) energizing said drive motor from a battery of an automobile.

5. The operating mechanism as claimed in claim 1 including means (39–40) disabling said drive motor responsive to the presence of an automobile in the building structure.

6. The operating mechanism as claimed in claim 1 wherein said arm (16) is further defined as having one end pivotally mounted on the door, the other end of said arm including means for supporting said arm so as to extend from the door generally in the direction of the opening movement of the door.

7. The operating mechanism as claimed in claim 6 further including a second cable (27) extending from the front to the rear of the building, at least one of said guide pulley and arm being coupled to said second cable for supporting said arm.

8. The operating mechanism as claimed in claim 1 wherein said motor is movable with respect to said axis of said drive pulley.

9. The operating mechanism as claimed in claim 8 wherein said motor carries out an electric switching function as a result of its movement.

10. The operating mechanism as claimed in claim 8 wherein said motor is rotatably movable with respect to said axis of said drive pulley.

11. The operating mechanism as claimed in claim 8 wherein said drive pulley is fastened to an axle mounted on said door and wherein said motor is suspended from said axle for movement.

12. The operating mechanism as claimed in claim 8 wherein said drive motor is movable along said axis for selectively coupling the drive motor to said drive pulley.

13. The operating mechanism as claimed in claim 12 wherein said motor is coupled to a handle (50) for the door and wherein the selective coupling of said motor is controlled by the handle.

14. The operating mechanism as claimed in claim 12 including means for selectively decoupling the motor responsive to predetermined applied loads.

15. The operating mechanism as claimed in claim 1 wherein said arm is pivotally mounted on the axis of said drive pulley.

16. The operating mechanism as claimed in claim 15 wherein said arm (16) has fork formed ends **(16*a*, 16*b*)** engaging the axis of said drive pulley.

17. The operating mechanism as claimed in claim 1 wherein said drive motor has a battery power source (4) mounted on said door.

18. The operating mechanism as claimed in claim 17 wherein said operating mechanism includes a battery recharger (37–38) connectable to said battery when the door is in the closed position.

19. The operating mechanism as claimed in claim 17 including solar cells (29) operatively associated with said batteries for recharging same.

* * * * *